US005903203A

United States Patent [19]

Elenbaas

[11] Patent Number: 5,903,203

[45] Date of Patent: May 11, 1999

[54] ELECTROMECHANICAL SWITCH

[76] Inventor: George H. Elenbaas, 25526 N. Shore Dr., Elkhart, Ind. 46514

[21] Appl. No.: 08/905,271

[22] Filed: Aug. 6, 1997

[51] Int. Cl.[6] ..... H01H 9/00

[52] U.S. Cl. ..... 335/179; 335/229

[58] Field of Search ..... 335/78–86, 124, 335/128, 129, 130, 131, 133, 134, 136, 177, 178, 179, 180, 181, 182–4, 229, 227, 228; 218/20–22

[56] References Cited

U.S. PATENT DOCUMENTS

| | | | |
|---|---|---|---|
| 2,297,402 | 9/1942 | Garber . | |
| 2,298,068 | 10/1942 | Pierce . | |
| 2,527,475 | 10/1950 | Bates . | |
| 2,632,072 | 3/1953 | Zellner | 335/177 |
| 2,749,403 | 6/1956 | Horman et al. . | |
| 2,900,476 | 8/1959 | Reece . | |
| 2,916,584 | 12/1959 | Molybeux | 335/229 |
| 2,919,324 | 12/1959 | Schuessler | 335/179 |
| 3,076,075 | 1/1963 | Colvill . | |
| 3,214,534 | 10/1965 | Pihl . | |
| 3,379,846 | 4/1968 | Wood et al. . | |
| 3,485,978 | 12/1969 | Grindell . | |
| 3,900,810 | 8/1975 | Granier . | |
| 3,959,616 | 5/1976 | Swanson et al. . | |
| 3,961,298 | 6/1976 | Jaffe et al. | 335/259 |
| 4,267,540 | 5/1981 | Iketani | 335/128 |
| 4,486,631 | 12/1984 | Naya et al. . | |
| 4,626,282 | 12/1986 | Naya et al. . | |
| 4,640,999 | 2/1987 | Kashiwagi et al. . | |
| 4,686,338 | 8/1987 | Kashiwagi et al. . | |
| 5,483,411 | 1/1996 | Sturman et al. . | |
| 5,519,370 | 5/1996 | Perreira et al. | 335/154 |

*Primary Examiner*—Lincoln Donovan
*Attorney, Agent, or Firm*—George Pappas

[57] ABSTRACT

An electromechanical switch including a non-magnetic cup shaped housing, the interior of which is sealed from the atmosphere with a seal assembly. A first electric terminal extends through the seal assembly and is connected to a coil spring. A second terminal includes a stationary electrode. The electrode extends through the seal assembly and through the coil spring. The coil spring supports a movable contact. A permanent magnet is selectively movable via a solenoid in close proximity to the contact member for selectively moving the contact member in and out of contact with electrode. In the closed position, electric current flows between the first and second terminals and through the coil spring. In another embodiment, an electric magnet provides the necessary flux for selectively moving the contact member. In yet another embodiment, two electrodes extend through the seal assembly and the movable contact is selectively placed in and out of contact with both of the electrodes for selectively controlling electric current flow between the terminals. The coil spring is preferably made of beryllium copper and the movable contact and electrodes are made of molybdenum. The interior of the non-magnetic housing can be evacuated placing it in a vacuum or filled with an arc quenching gas.

33 Claims, 3 Drawing Sheets

ELECTROMECHANICAL SWITCH

TECHNICAL FIELD

The device of the present invention generally relates to the technical field of switching electrical current on and off between two electrical conductors. More particularly, the device of the present invention is directed to an improved electromechanical switch or relay which is automatically switched between its on and off states and which is more reliable, generally inexpensive to manufacture, and long lasting.

BACKGROUND OF THE INVENTION

Electromechanical switches and relays are very commonly used in various applications for automatically selectively switching electrical current on and off. For example, such switches or relays are used in heating, ventilating and air conditioning systems, automobiles and trucks, control circuits, etc. Typically, such switches or relays have a life span which, in large part, depends on the wear of the contacts which occurs as a result of electroerosion. That is, electric sparks occur between the switch contacts which are selectively moved and placed in contact with or apart from one another. These sparks evaporate and/or otherwise deteriorate the contact surfaces thereby eventually decreasing the effective contact surface and also increasing the resistance therebetween such as by accumulation of carbon. This ultimately causes the switch or relay to fail or otherwise become unable to carry or transfer a sufficient current between the conductors.

It is known that electroerosion and carbon buildup on contact surfaces is significantly decreased when the contact action occurs in the absence of air or in a vacuum or if the contact action occurs in the presence of certain arc quenching gases. However, in practice, locating the contacts within a reliable vacuum or arc quenching gas filled enclosure and reliably and inexpensively selectively causing movement of the contacts can be quite difficult. One prior solution, as for example shown in U.S. Pat. No. 3,379,846 to Wood et al., has been to utilize a vacuum tight bellows. There, the contacts are located within a vacuum tight housing or enclosure and are manipulated for switching on and off by mechanical movement which occurs through the bellows. Unfortunately, the bellows of such switches tends to fail over time thereby losing the vacuum or the gases within the switch enclosure or housing. Further, such bellows are typically made of relatively bulky materials making such switches relatively large in size and expensive.

Accordingly, a need exists for an improved electromechanical switch or relay that incorporates a housing or enclosure wherein the switch contacts are located and are isolated from the atmosphere, and wherein the contacts can be manipulated without jeopardizing the integrity of the enclosure or housing and, further, wherein the contacts can be manipulated reliably and the electromechanical switch operates for a substantial number of operations.

SUMMARY OF THE INVENTION

It is the principal object of the present invention to overcome the above-discussed disadvantages associated with prior electromechanical switches and relays.

The present invention overcomes the disadvantages associated with prior electromechanical switches and relays by providing a cup shaped switch housing made of non-magnetic material and a cap closing and sealing the switch housing interior from the atmosphere. A set of terminals preferably extend through the cap and to the inside of the non-magnetic switch housing. Within the switch housing, a coil spring preferably made of beryllium copper, at one end, is electrically connected to the first terminal and, at its other end, supports a contact member which is connected thereto. Within the switch housing, the second terminal includes a stationary elongate electrode which extends through the coil spring and is selectively placed in and out of contact with the movable contact member. The contact member, also referred to herein as the armature, includes a magnetic plate preferably made of soft iron. The contact member is placed in and out of contact with the electrode by selectively providing a magnet next to the non-magnetic switch housing and in close proximity to the contact member thereby selectively providing magnetic flux through the non-magnetic switch housing. The magnetic flux causes the selective attraction of the contact member and movement thereof against the force of the coil spring.

In one embodiment, the coil spring is a compression spring biasing or drawing the contact member toward and in contact with the stationary elongate electrode. A solenoid is provided having a selectively movable plunger which is adapted to move a permanent magnet in and out of close proximity to the switch housing and contact member. A plunger spring is provided for biasing the plunger and permanent magnet toward and in close proximity to the switch housing and contact member. Accordingly, the permanent magnet normally retains the contact member away from the electrode and thereby providing a normally open switch condition. By energizing the solenoid coil, the plunger and permanent magnet are moved away from the switch housing thereby allowing the coil spring within the switch housing to draw or pull the contact member in contact with the electrode thereby closing the switch.

In another embodiment, the plunger spring normally forces the plunger and permanent magnet away from the switch housing and the contact member and the coil spring within the switch housing normally retain the contact member in contact with the electrode. Accordingly, this switch is normally closed. By energizing the solenoid coil, the plunger and permanent magnet are moved against the force of the plunger spring and in close proximity to the switch housing and contact member. The permanent magnet attracts or draws the contact member against the force of the coil spring away from the electrode thereby opening the circuit or electromechanical switch.

In another embodiment, an electric magnet is provided adjacent the non-magnetic switch housing and in close proximity to the contact member. By selectively energizing the electric magnet, the contact member which is normally in contact with the electrode is drawn or attracted against the force of the coil spring within the switch housing and away from the electrode thereby opening the circuit of the electromechanical switch.

In yet another embodiment, the two terminals extending within the non-magnetic switch housing both form stationary electrodes and a contact member is selectively movable in and out of contact with both of the stationary electrodes. An armature or contact member spring is provided within the non-magnetic switch housing for biasing or forcing the contact member toward and in contact with both of the stationary electrodes. A solenoid including a plunger is provided for selectively moving a permanent magnet either away from the switch housing and contact member or in close proximity thereto. In one aspect of this embodiment, a plunger spring biases or forces the plunger and permanent magnet in close proximity to the switch housing and contact member thereby drawing or forcing the contact member away from the two stationary electrodes and thereby providing a normally open electromechanical switch. By energizing the solenoid coil, the plunger and permanent magnet are forced away from the switch housing against the force of the plunger spring and the magnetic flux attraction to the contact member thereby allowing the armature spring to push the contact member against the two stationary electrodes and thereby closing the circuit or switch. In another aspect of this embodiment, the plunger spring urges or pushes the plunger and permanent magnet away from the switch housing and the contact member thereby normally allowing the spring within the switch housing to retain the contact member against and in contact with the two stationary electrodes. Accordingly, this switch is normally closed. By energizing the solenoid coil, the plunger and permanent magnet are pushed against the force of the plunger spring placing the permanent magnet in close proximity to the switch housing and contact member thereby attracting or drawing the contact member away from the stationary electrodes and opening the circuit or switch.

Preferably, in all of the different embodiments, the switch housing and solenoid or electric magnet are located within a non-conductive exterior housing. Further, prior to sealing the non-magnetic switch housing, the interior thereof is either evacuated for providing a vacuum or is filled with one or more arc quenching gases such as argon, hydrogen, sulfurhexafluoride or a mixture of these. The non-magnetic switch housing and cap or seal assembly tightly seal in the vacuum or gasses contained therein along with the electrodes and movable contacts. Absent physical destruction of the cap or the switch housing the vacuum or arc quenching gases are retained and the electrodes and contacts are not exposed to the atmosphere. Thus, electroerosion between the armature or contact member and the electrodes is significantly decreased and the life expectancy of the electromechanical switch is increased.

In one form thereof, the present invention is directed to an electromechanical switch including a first electric terminal and a second electric terminal. A coil spring having a first end and a second end is provided and the coil spring first end is electrically connected to the first electric terminal. The coil spring second end is selectively movable in and out of contact with the second terminal. When the coil spring second end is in contact with the second terminal, electric current can travel between the first and second terminals and through the coil spring.

In one form thereof, the present invention is directed to an electromechanical switch including a first electric terminal and a second electric terminal. A spring is provided having a first end and a second end and the spring first end is electrically connected to the first electric terminal. A contact member is attached to the spring and the spring is selectively movable for placing the contact member in and out of contact with the second terminal. A magnet mechanism selectively moves the contact member against the force of the spring thereby selectively placing the contact in and out of contact with the second terminal.

In one form thereof, the present invention is directed to an electromechanical switch including a first electric terminal and a second electric terminal. A contact member is provided and is selectively movable in and out of contact with the first and second electric terminals whereby, when the contact member is in contact with the first and second terminals, electric current can travel between the terminals and through the contact member. A magnet mechanism is provided for selectively moving the contact member in and out of contact with the first and second terminals.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE PREFERRED EMBODIMENTS

Figure 1:
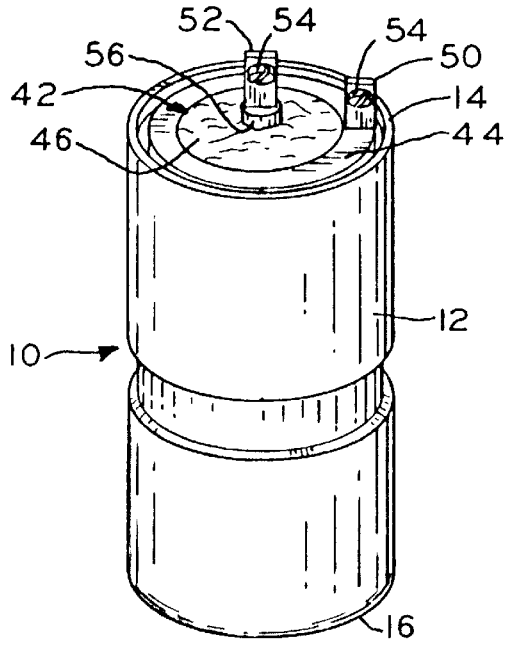
FIG. 1 is a perspective view of the exterior of an electromechanical switch constructed in accordance with the principles of the present invention.
Figure 2:
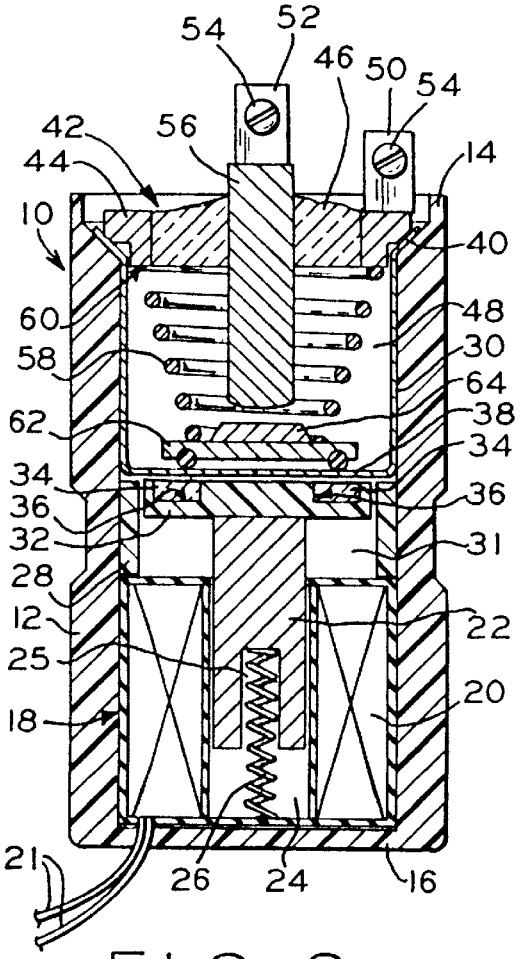
FIG. 2 is a cross-sectional view of the electromechanical switch shown in FIG. 1 and shown in its normally open position.
Figure 3:
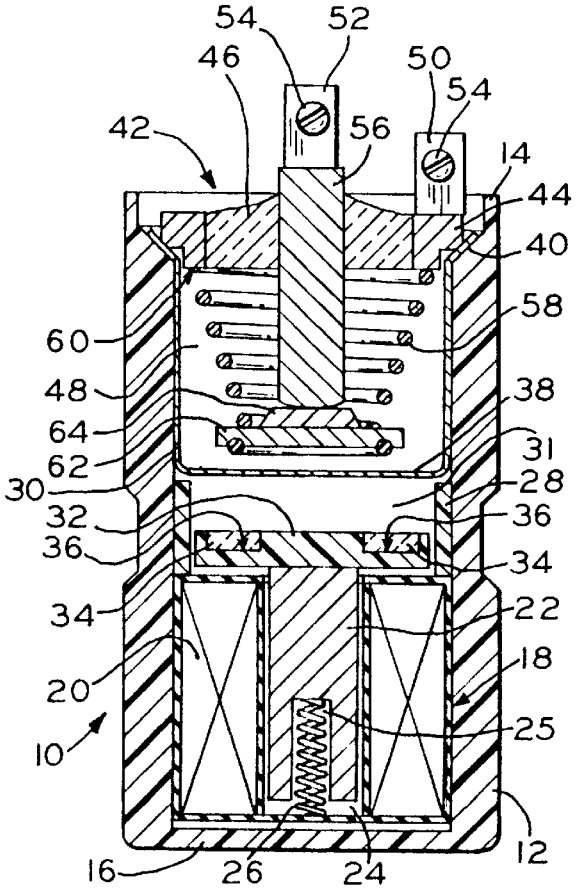
FIG. 3 is a cross-sectional view of the electromechanical switch shown in FIG. 2 but in a closed position.

Referring initially to FIGS. 1–3, an electromechanical switch constructed in accordance with the principles of the present invention, is shown and generally designated by the numeral 10. Electromechanical switch 10 includes a non-conductive exterior housing 12 which is generally cylindrically shaped having an open top end 14 and closed bottom end 16. Non-conductive exterior housing 12 is preferably made of plastic and is formed by injection molding.

A solenoid generally shown and designated by the numeral 18 is provided and is located within the exterior housing 12 near the closed bottom end 16 thereof. Solenoid 18 includes an electric coil 20 which is selectively energized by providing electric current in a known and customary manner through the wires 21 shown only in FIG. 2. Solenoid 18 further includes a plunger 22 made of a magnetic material such as soft iron and which is selectively longitudinally movable within the coil bore 24 in a known and customary manner. Plunger 22 includes a central longitudinal bore 25 which at least in part receives therein a plunger spring 26. Plunger spring 26 is a compression spring and urges or pushes plunger 22 upwardly toward the exterior housing open top end 14 and in the position as shown in FIG. 2. When coil 20 is energized, plunger 22 is forced downwardly toward the exterior housing closed bottom end 16 against the magnetic force caused by magnets 34 being attracted to plate 62 and the force of plunger spring 26 and in a position as shown in FIG. 3.

Above solenoid coil 20, an annular spacer 28 preferably made of a non-conductive, non-magnetic material such as plastic is provided. Spacer 28 supports the non-magnetic switch housing 30. The longitudinal length of annular spacer 28 defines a bore 31 and, thus, the longitudinal travel distance of plunger 22. At the end opposite the bore 25 of plunger 22, a disk shaped non-magnetic support member 32 is provided and is attached to the plunger 22. One or more permanent magnets 34 are carried on the disk shaped support member 32. Permanent magnets 34 are received within the openings 36 on the top surface of disk shaped support member 32 and are retained therein by friction fit, adhesives, or other suitable means. Accordingly, the disk shaped support member 32, along with the permanent magnets 34 carried thereon, are selectively movable along with plunger 22 by selectively energizing coil 20. More specifically, the disk shaped member 32 and permanent magnets 34 are selectively movable between a position in close proximity or adjacent the bottom or closed end 38 of non-magnetic switch housing 30 as shown in FIG. 2 and a position longitudinally away therefrom as shown in FIG. 3.

The non-magnetic switch housing 30 is generally can shaped having a bottom or closed end 38 and an out turned lip 40 and is preferably made of non-magnetic stainless steel. Non-magnetic can 30 can be formed by machining and/or drawing and stamping processes. At its upper open end, the switch housing 30 is completely closed off to the atmosphere via a cap or seal assembly shown and generally designated by the numeral 42. Cap or seal assembly 42 includes an annular shaped weldring 44 abutting housing lip 40 and attached thereto by an annular resistance weld or other suitable means. The cap or seal assembly 42 further includes a disk shaped glass bead 46 received within the weldring 44. The interconnection between glass bead 46 and the weldring 44 and the interconnection between glass bead 46 and elongate electrode 56 along with the interconnection between the weldring 44 and lip 40 of housing 30 are constructed in known and customary manner for providing a hermetically sealed housing interior volume or area 48.

The seal assembly 42 further includes a set of electric terminals 50 and 52 which are preferably made of copper, brass or other alloys which are electrically conductive. Terminals 50 and 52 are adapted to be connected to electrical wires or conductors (not shown) in a known and customary manner such as by spade connectors (not shown) or screws 54. Electric terminal 52 serves as the stationary contact along with the elongate electrode 56 which is generally centered and extends through the glass bead 46. Stationary elongate electrode 56 is preferably made of molybdenum.

Electric terminal 50 is preferably brazed or welded to weldring 44 for providing an electrical connection therebetween. A coil spring 58, at its upper end, is welded or brazed to the lower annular surface 60 of weldring 44. At the lower end of coil spring 58 an armature disk shaped plate 62 is supported. Disk shaped plate 62 is preferably made of soft iron and is attached to the end of coil spring 58 by brazing, welding, or other suitable means. A movable contact 64 made of molybdenum which is generally disk shaped is located on the soft iron plate 62. Contact 64 is attached to the disk shaped plate 62 by brazing or other suitable means. It is noted that coil spring 58 is preferably frusto-conical shaped as shown and is made of beryllium copper. As shown, electric terminal 50 provides an electrical connection to coil spring 58 through weldring 44. Further, terminals 52 and/or 50 extending through the glass bead 46 are also hermetically sealed interconnections for providing a hermetically sealed housing interior 48. As should now be appreciated, electric current can travel through electric terminal 50, to weldring 44, through coil spring 58 and to the plate 62 and contact 64. Electric current can also flow through the electric terminal 52 and the stationary electrode 56 thereof.

In operation, the electromechanical switch 10 shown in FIGS. 2 and 3 is normally open. That is, as shown in FIG. 2 when coil 20 is not energized, plunger 22 and permanent magnets 34 are forced or urged longitudinally upwardly by plunger spring 26 placing the permanent magnets 34 adjacent or in close proximity to the switch housing bottom or closed end 38 and the plate 62 and contact 64. In this position, permanent magnets 34 provide flux that extends through the non-magnetic housing bottom or closed end 38 thereby drawing or attracting the soft iron plate 62 and contact 64, against the force of coil spring 58, downwardly toward permanent magnets 34. Thus, contact 64 is separated from electrode 56 thereby preventing electric current flow between terminals 50 and 52.

By energizing the solenoid coil 20 as discussed hereinabove, plunger 22 and permanent magnets 34 are caused to travel downwardly in the position as shown in FIG. 3 away from the non-magnetic housing bottom or closed end 38. Here, the flux of permanent magnets 34 is sufficiently far from the soft iron plate 62 so that the coil spring 58 overcomes the force created by the permanent magnets 34 and so that the soft iron plate 62 and contact 64 are pulled longitudinal upwardly as shown in FIG. 3, placing contact 64 in contact with electrode 56. With contact 64 in this position, electric current flows through the terminal 50, weldring 44, coil spring 58, to soft iron plate 62 and contact 64 and then through electrode 56 to terminal 52.

So as to increase the life span of electromechanical switch 10, prior to attachment of the seal assembly 42 upon the non-magnetic housing 30, the housing interior 48 is either evacuated placing it in a vacuum or is filled with one or more arc quenching gases such as argon, hydrogen, sulfurhexafluoride or a mixture of these. As should now be appreciated, the molybdenum contact 64 and electrode 56 in combination with the vacuum or arc quenching environment substantially decrease arcing and electroerosion between contact 64 and electrode 56 thereby significantly increasing the life span of the electromechanical switch 10.

Figure 4:
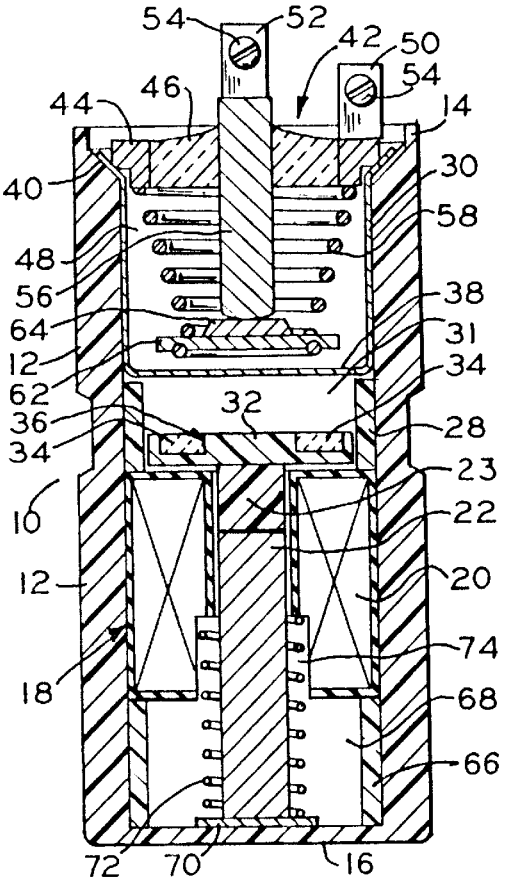
FIG. 4 is a cross-sectional view of a second embodiment of an electromechanical switch constructed in accordance with the principles of the present invention and shown in its normally closed position.
Figure 5:
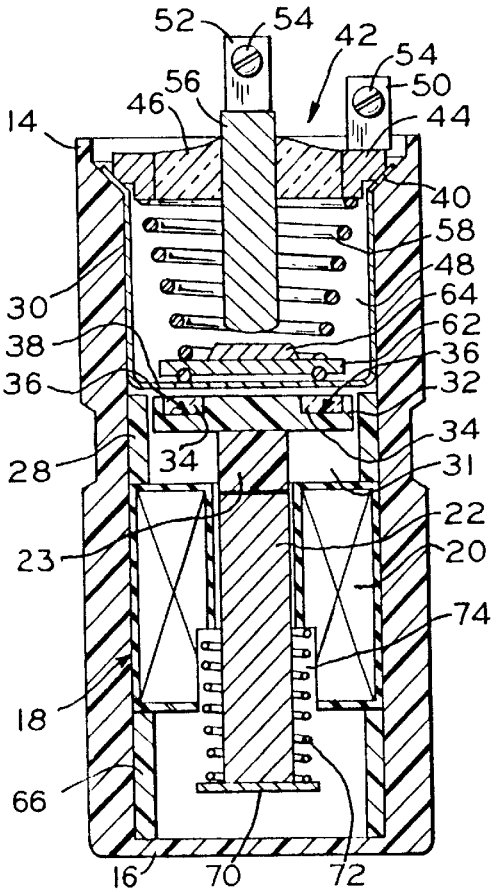
FIG. 5 is a cross-sectional view of the electromechanical switch shown in FIG. 4 but showing the switch in an open position.

In the embodiment shown in FIGS. 4 and 5, the electromechanical switch 10 is substantially identical to that of FIGS. 2 and 3 except that the solenoid 18 is modified for making this switch normally closed. Here, a solenoid annular spacer ring 66 is located within the non-conductive exterior housing 12 between closed bottom end 16 and the solenoid coil 20. Solenoid annular spacer ring 66 supports coil 20 and, further, forms plunger entry cavity 68. Here, plunger 22 is not provided with a bore 24 but, rather, a spring stop disk 70 is attached at the lower end thereof so that plunger spring 72 may act thereagainst and force the spring stop 70 and plunger 22 downwardly as shown in FIG. 4. Further, plunger 22 is provided with a non-magnetic portion 23. As shown in FIGS. 4 and 5, coil 20 may be formed with an annular gap 74 whereat plunger spring 72 may be partially located or, in the alternative, plunger spring 72 may be sized differently so as to bear against the lower surface of coil 20 and operate and be located solely within the plunger entry cavity 68.

In operation, the electromechanical switch 10 of FIGS. 4 and 5 is normally closed with plunger 22 in the position as shown in FIG. 4. Here, plunger spring 72 pushes plunger 22 along with non-magnetic support member 32 and permanent magnets 34 downwardly and away from bottom 38, plate 62 and movable contact 64. In this position, the magnetic flux of magnets 34 attracting plate 62 and contact 64 is insufficient to overcome the force of coil spring 58 and, therefore, coil spring 58 draws or forces plate 62 and contact 64 upwardly and in contact with the stationary elongate electrode 56. In this position, electric current freely flows from terminal 50 through coil spring 58, contact 64, electrode 56 and to the other terminal 52. By energizing coil 20, plunger 22 seeks its lowest energy position and, in view of non-magnetic portion 23, is caused to move longitudinally upwardly against the force of plunger spring 72 and in a position as shown in FIG. 5 whereat magnets 34 are placed in close proximity to the bottom 38 of non-magnetic switch housing 30 and soft iron plate 62 and movable contact 64. In this position, magnets 34 are sufficiently close so as to draw or attract the soft iron plate 62 and contact member 64 longitudinally downwardly toward magnets 34 against the force of coil spring 58 and away from the stationary elongate electrode 56. Accordingly, the circuit is opened preventing electrical current flow between electric terminals 50 and 52.

Figure 8:
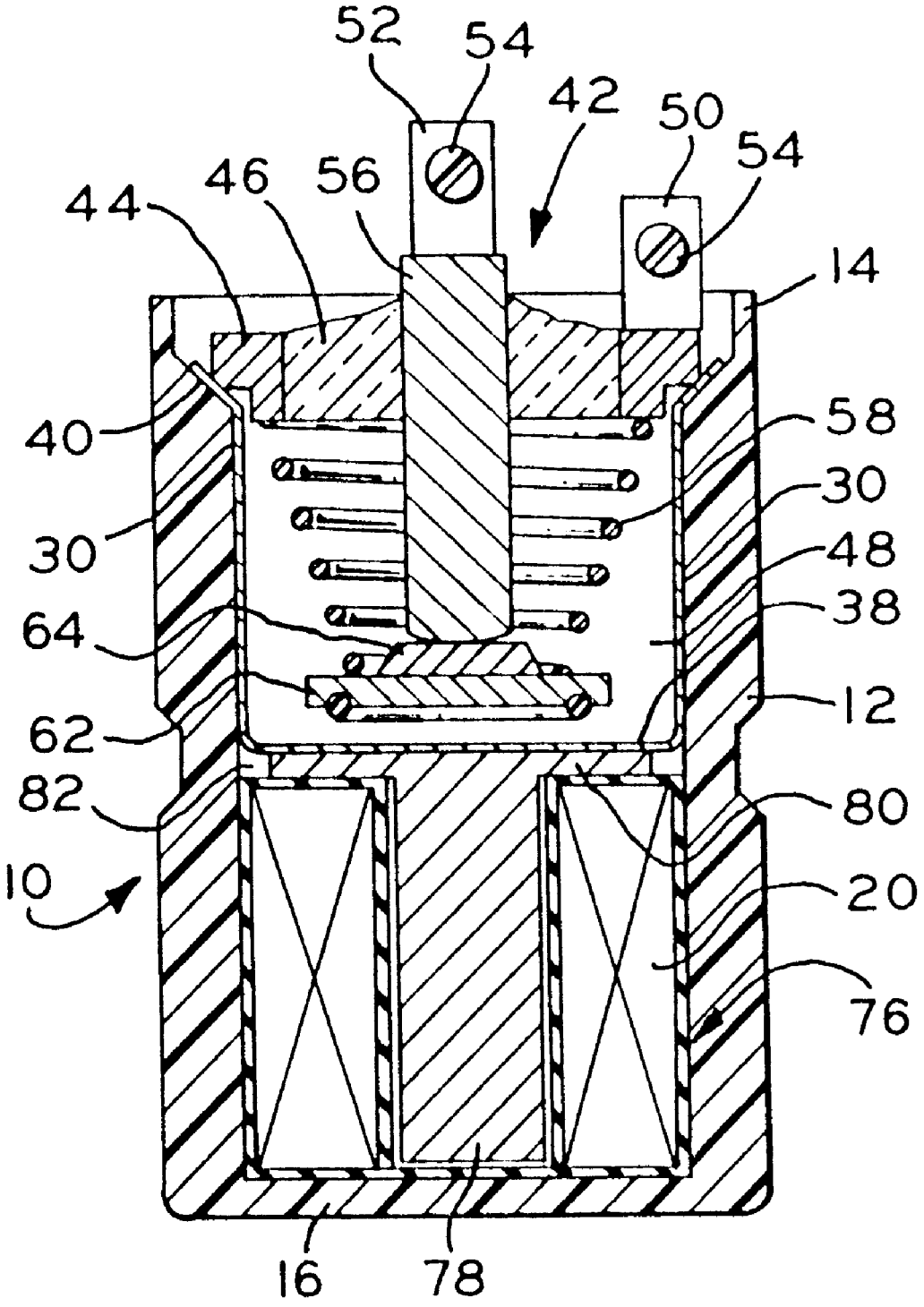

Referring now to the embodiment shown in FIG. 8, electromechanical switch 10 is provided with an electric magnet 76 for selectively providing magnetic flux and moving the soft iron plate 62 and the movable contact 64. Electric magnet 76 includes an electric coil 20 and a stationary core 78 made of a magnetic material. Stationary core 78 is preferably integrally formed with or attached to a disk shaped core portion 80. An annular spacer 82 is provided therearound and between coil 20 and the bottom 38 of a non-magnetic switch housing 30. In operation, the electromechanical switch 10 of FIG. 8 is normally closed as shown. That is, coil 20 is not energized and no magnetic flux or force is provided thereby allowing the coil spring 58 to draw or pull up the armature disk shaped plate 62 and the movable contact 64 upwardly and in contact with the stationary elongate electrode 56. In this position, electric current freely flows between electric terminals 50 and 52 as described hereinabove. By energizing coil 20 with direct current, magnetic flux is created causing core 78 along with the disk shaped core portion 80 to become magnetic. The flux from this electric magnet is of sufficient strength and it is sufficiently close so as to attract or pull the soft iron plate 62 and movable contact 64 downwardly toward core 78 and away from the stationary elongate electrode 56. In that position, and so long as coil 20 remains energized, the electromechanical switch of FIG. 8 remains open and preventing electric current flow between electrical terminals 50 and 52.

Figure 6:
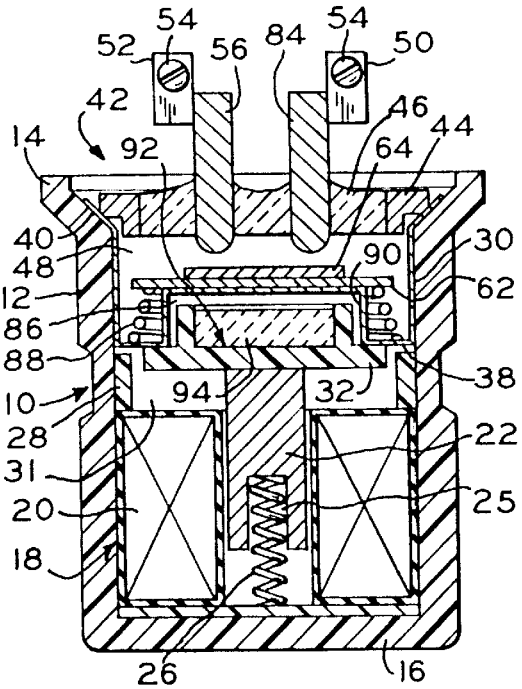
FIG. 6 is a cross-sectional view of yet another embodiment of an electromechanical switch constructed in accordance with the principles of the present invention and shown in its normally open position.
Figure 7:
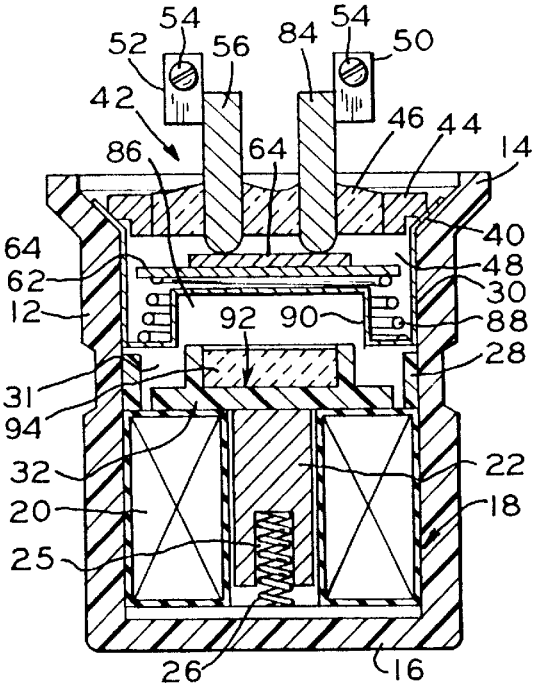
FIG. 7 is a cross-sectional view of the electromechanical switch shown in FIG. 6 but showing the switch in a closed position; and, FIG. 8 is a cross-sectional view of yet another embodiment of an electromechanical switch constructed in accordance with the principles of the present invention and showing the switch in its normally closed position.

Referring now to the embodiment of FIGS. 6 and 7, the electromechanical switch 10, similar to that of FIGS. 2 and 3, includes an electric terminal 52 and a stationary elongate electrode 56 extending through the glass bead 46. However, electric terminal 50 here also includes a stationary elongate electrode 84 extending through the glass bead 46 similar to electrode 56. Thus, both electrodes 56 and 84 extend into the interior 48 of non-magnetic switch housing 30. Here, the housing bottom 38 is formed with a disk shaped depression 86 extending into the interior 48 as shown. An armature coil contact spring 88 surrounds the annular wall 90 of housing 30 forming the depression 86. Contact spring 88 supports the armature disk shaped plate 62 and contact member 64 urging or pushing them toward electrodes 56 and 84. Disk shaped 62 is preferably made of soft iron whereas movable contact 64 along with electrodes 56 and 84 are preferably made of molybdenum.

The solenoid 18 is quite similar to and operates the same as the embodiment of FIGS. 2 and 4 except that the disk shaped non-magnetic support member 32 includes a single, preferably disk shaped, opening 92 wherein there is received a permanent magnet 94. As best seen in FIG. 6, permanent magnet 94 is selectively received within the disk shaped depression 86 of housing bottom 38 so as to be in close proximity to the plate 62 and movable contact 64.

In operation, the plunger spring 26 of the electromechanical switch 10 shown in FIG. 6 urges or pushes the plunger 22 and permanent magnet 94 longitudinally upwardly as shown for placing the permanent magnet 94 within the depression 86 and in close proximity to the plate 62 and movable contact 64. In this position, permanent magnet 94 attracts or draws plate 62 and contact 64 longitudinally downwardly against the force of coil spring 88 as shown and away from electrodes 56 and 84. In this position, electric current cannot flow from electric terminal 50 to electric terminal 52 and, therefore, this switch is normally open. By energizing coil 20 of solenoid 18, plunger 22 is drawn or forced longitudinally downwardly against the magnetic force caused by magnet 94 being attracted to plate 62 and the force of plunger spring 26 and placing the plunger 22 and permanent magnet 94 in the position as shown in FIG. 7. Here, the strength of permanent magnet 94 and the distance thereof from plate 62 and contact 64 are such that the overall magnetic attraction does not overcome the force of armature contact spring 88 and, therefore, spring 88 pushes or forces plate 62 and the movable contact 64 longitudinally upwardly as shown and in contact with both electrodes 56 and 84. Accordingly, electric current can flow between terminals 50 and 52 by traveling through the electrodes 56 and 84 and the movable contact member 64.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electromechanical switch comprising:

a first electric terminal;

a second electric terminal;

a coil spring having a first end and a second end, said coil first spring end being electrically connected to said first electric terminal;

wherein said coil spring second end is selectively movable in and out of electrical contact with said second terminal;

wherein when said coil spring second end is in electrical contact with said second terminal, electric current travels between said first and second terminals and through said coil spring; and, wherein said second terminal includes a stationary elongate electrode extending through said coil spring, said coil spring second end being movable in and out of electrical contact with said stationary elongate electrode.

2. The electromechanical switch of claim 1, further comprising a contact member attached to said spring second end, said spring being selectively movable for placing said contact member in and out of electrical contact with said stationary elongate electrode.

3. The electromechanical switch of claim 2, further comprising means for selectively moving said contact member against a force of said coil spring thereby selectively placing said contact member in and out of contact with said stationary elongate electrode.

4. The electromechanical switch of claim 2, further comprising a permanent magnet selectively movable in and out of close proximity to said contact member, whereby said permanent magnet selectively attracts said contact member against a coil spring force thereby selectively placing said contact member in and out of contact with said stationary elongate electrode.

5. The electromechanical switch of claim 4, wherein said permanent magnet is normally in close proximity to said contact member and attracts said contact member against said coil spring force and away from said stationary elongate electrode, and further comprising a solenoid having a plunger attached to said permanent magnet, whereby selective energizing of said solenoid moves said plunger and said permanent magnet away from said contact member thereby allowing said coil spring force to draw said contact member toward and in contact with said stationary elongate electrode.

6. The electromechanical switch of claim 5, further comprising a plunger spring biasing said plunger and permanent magnet in close proximity to said contact member.

7. The electromechanical switch of claim 4, wherein said permanent magnet is normally not in close proximity to said contact member whereby said coil spring force draws said contact member toward and in contact with said stationary elongate electrode, and further comprising a solenoid having a plunger attached to said permanent magnet, whereby selective energizing of said solenoid moves said plunger and said permanent magnet in close proximity to said contact member and attracts said contact member against said coil spring force and away from said stationary elongate electrode.

8. The electromechanical switch of claim 7, further comprising a plunger spring biasing said plunger and permanent magnet away from said contact member.

9. The electromechanical switch of claim 2, further comprising an electric magnet located in close proximity to said contact member, whereby selective energizing of said electric magnet attracts said contact member against a force of said coil spring thereby selectively placing said contact member in and out of contact with said stationary elongate electrode.

10. The electromechanical switch of claim 2, further comprising a non-magnetic housing and said terminals extend into said housing, and wherein said coil spring, stationary elongate electrode, and said contact member are located within said housing.

11. The electromechanical switch of claim 10, wherein said housing is at least partially purged of air for providing a vacuum.

12. The electromechanical switch of claim 10, wherein said housing is filled with one or more gases selected from a group of argon, hydrogen sulfurhexafluoride and a mixture thereof.

13. The electromechanical switch of claim 10, further comprising means for selectively moving said contact member against a force of said coil spring thereby selectively placing said contact member in and out of contact with said stationary elongate electrode.

14. An electromechanical switch comprising:

a first electric terminal;

a second electric terminal;

a coil spring having a first end and a second end, said coil first spring end being electrically connected to said first electric terminal;

wherein said coil spring second end is selectively movable in and out of electrical contact with said second terminal;

wherein when said coil spring second end is in electrical contact with said second terminal, electric current travels between said first and second terminals through said coil spring; and, further comprising means for selectively moving said coil spring for selectively placing said coil spring in and out of contact with said second terminal.

15. An electromechanical switch comprising:

a first electric terminal;

a second electric terminal;

a coil spring having a first end and a second end, said coil first spring end being electrically connected to said first electric terminal;

wherein said coil spring second end is selectively movable in and out of electrical contact with said second terminal;

wherein when said coil spring second end is in electrical contact with said second terminal, electric current travels between said first and second terminals through said coil spring; and, further comprising a contact member attached to said coil spring second end, said spring being selectively movable for placing said contact member in and out of contact with said first electric terminal.

16. The electromechanical switch of claim 15, further comprising means for selectively moving said contact member against a force of said coil spring thereby selectively placing said contact member in and out of contact with said second electric terminal.

17. The electromechanical switch of claim 1, further comprising a non-magnetic housing, said terminals extending into said housing and wherein said coil spring is located within said housing.

18. The electromechanical switch of claim 17, wherein said housing is at least partially purged of air for providing a vacuum.

19. The electromechanical switch of claim 17, wherein said housing is filled with one or more gases selected from a group of argon, hydrogen, sulfurhexafluoride and a mixture thereof.

20. The electromechanical switch of claim 17, wherein said coil spring is made of beryllium copper.

21. The electromechanical switch of claim 1, wherein said coil spring is made of beryllium copper.

22. An electromechanical switch comprising:

a first electric terminal;

a second electric terminal;

a spring having a first end and a second end, said spring first end electrically connected to said first electric terminal;

a contact member attached to said spring and wherein said spring is selectively movable for placing said contact member in and out of contact with said second terminal;

a means for selectively moving said contact member against a force of said spring thereby selectively placing said contact member in and out of contact with said second terminal; and, wherein said means for selectively moving comprises a permanent magnet selectively movable in and out of close proximity to said contact member, whereby said permanent magnet selectively attracts said contact member against a force of said spring thereby selectively placing said contact member in or out of contact with said second terminal.

23. The electromechanical switch of claim 22, further comprising solenoid means for selectively moving said permanent magnet in and out of close proximity to said contact member.

24. The electromechanical switch of claim 22, wherein said means for selectively moving comprises an electric magnet in close proximity to said contact member, whereby selective energizing of said electric magnet attracts said contact member and selectively places said contact member in and out of contact with said second terminal.

25. The electromechanical switch of claim 22, further comprising a non-magnetic housing, said terminals extending into said housing, and wherein said spring and said contact member are located within said housing.

26. The electromechanical switch of claim 25, wherein said housing is at least partially purged of air for providing a vacuum.

27. The electromechanical switch of claim 25, wherein said housing is filled with one or more gases selected from a group of argon, hydrogen, sulfurhexafluoride and a mixture thereof.

28. An electromechanical switch comprising:

a first electric terminal;

a second electric terminal;

a contact member selectively movable in and out of contact with said first and second electric terminals, whereby when said contact member is in contact with said first and second terminals electric current can travel between said terminals and through said contact member;

magnet means for selectively moving said contact member in and out of contact with said first and second terminals; and, wherein said magnet means is a permanent magnet selectively movable in and out of close proximity to said contact member, whereby said permanent magnet selectively attracts said contact member and selectively places said contact member in or out of contact with said first and second terminals.

29. The electromechanical switch of claim 28, further comprising a non-magnetic housing and wherein said terminals extend into said housing, and further comprising a spring within said housing for selectively biasing said contact member in a direction opposite the attraction of said permanent magnet.

30. The electromechanical switch of claim 29, further comprising solenoid means for selectively moving said permanent magnet in and out of close proximity to said contact member.

31. The electromechanical switch of claim 29, wherein said housing is at least partially purged of air for providing a vacuum.

32. The electromechanical switch of claim 29, wherein said housing is filled with one or more gases selected from a group of argon, hydrogen, sulfurhexafluoride and a mixture thereof.

33. The electromechanical switch of claim 28, further comprising solenoid means for selectively moving said permanent magnet in and out of close proximity to said contact member.

* * * * *